United States Patent [19]

Marino

[11] Patent Number: 5,054,160

[45] Date of Patent: Oct. 8, 1991

[54] WATER HEATER TANK CLEANING KIT

[76] Inventor: Richard L. Marino, 2737 Demington N.W., Canton, Ohio 44718

[21] Appl. No.: 470,377

[22] Filed: Jan. 25, 1990

[51] Int. Cl.[5] ..... A47L 9/06

[52] U.S. Cl. ..... 15/401; 15/395; 15/414; 15/415.1

[58] Field of Search ..... 15/415.1, 395, 414, 15/401

[56] References Cited

U.S. PATENT DOCUMENTS

| | | | |
|---|---|---|---|
| 1,446,854 | 2/1923 | Marshall | 15/401 |
| 2,101,222 | 12/1937 | McCracken | 15/414 X |
| 2,715,240 | 8/1955 | Pieper et al. | 15/415.1 |
| 2,879,530 | 3/1959 | Ego | 15/401 X |
| 4,053,962 | 10/1977 | McDowell | 15/415.1 |
| 4,237,572 | 12/1980 | Larson | 15/236.05 X |
| 4,694,529 | 9/1987 | Choiniere | 15/593 |
| 4,976,004 | 12/1990 | Bufford-Thacker | 15/415.1 |

FOREIGN PATENT DOCUMENTS

| | | | |
|---|---|---|---|
| 642989 | 6/1962 | Canada | 15/414 |

*Primary Examiner*—Chris K. Moore
*Attorney, Agent, or Firm*—Leon Gilden

[57] ABSTRACT

A kit including a coupler for sealing engagement to a vacuum intake nozzle such as utilized by "shop type" vacuum canisters. The kit further includes an adapter member threadedly securable to the coupler, wherein the adapter member sealingly and slidingly receives therewithin one of a plurality of vacuum wands of generally "L" shaped configuration, with a first wand defining an acute angle and the second wand defining an orthogonal relationship between its legs. The first and second wands are utilized to respectively clean a major and minor sector of a hot water tank, and particularly sediment collected on the bottom portion of the tank.

1 Claim, 5 Drawing Sheets

PRIOR ART 13
11
18
17
14
19

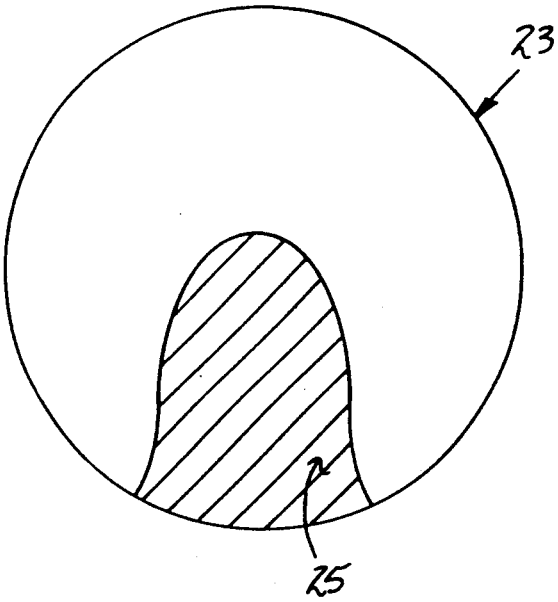
FIG 11
FIG 12
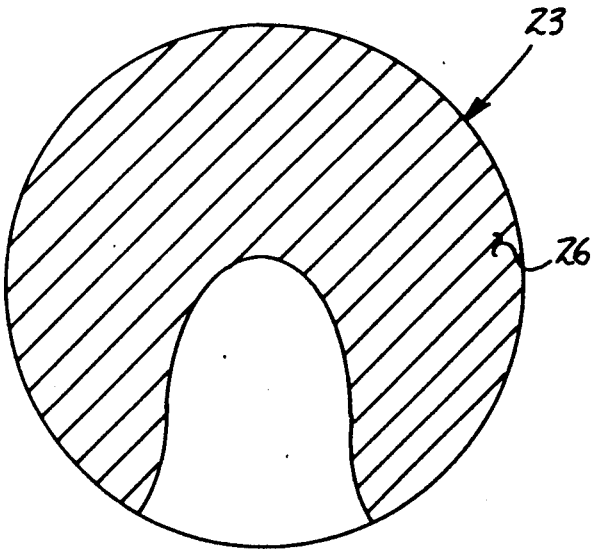

WATER HEATER TANK CLEANING KIT

BACKGROUND OF THE INVENTION

1. Field of the Invention

The field of invention relates to vacuum apparatus, and more particularly pertains to a new and improved water heater tank cleaning kit wherein the same provides ease of use in the cleaning of a water tank and especially in removing sediment from the bottom portion of the tank.

2. Description of the Prior Art

The use of vacuum apparatus for the cleaning of various surfaces is well known in the prior art. Vacuums of the prior art have been of a generally generic construction to avail themselves of cleaning a large spectrum of areas and forums. The prior art has heretofore failed to provide an assembly utilized in particular for the cleaning of a hot water tank and sediment collected on the bottom portion thereof. Examples of the prior art includes U.S. Pat. No. 3,938,218 to DeAmicis wherein the patent provides a telescoping cleaning tool utilized with a restricted forward end for the cleaning of relatively inaccessible areas and coupled to a source of pressurized air to permit directing of the pressurized air to the aforenoted surfaces.

U.S. Pat. No. 4,715,088 to Haase sets forth a vacuum cleaner attachment utilized with a conventional vacuum cleaner nozzle formed with slotted side walls and the attachment is moved in a side-to-side manner during cleaning.

U.S. Pat. No. 4,694,529 to Choiniere sets forth an apparatus provided with a generally planar forward end and directed to a cylindrical rear portion for securement to a vacuum cleaner nozzle to enable the blade access to remote areas of cleaning.

U.S. Pat. No. 3,244,437 to Belicka, et al., wherein the same utilizes a conventional vacuum cleaner with a telescoping wand mounted thereto.

U.S. Pat. No. 2,624,061 to Leas provides a further example of an extensible wand utilized in a cleaning procedure with a mechanical inter-relationship between the telescoping extension and the main body of the wand.

As such, it may be appreciated that there is a continuing need for a new and improved water heater tank cleaning kit wherein the same addresses both the problems of ease of use and effectiveness in construction in enabling access to a sediment tank portion of a water tank, and in this respect, the present invention substantially fulfills this need.

SUMMARY OF THE INVENTION

In view of the foregoing disadvantages inherent in the known types of vacuum cleaner apparatus now present in the prior art, the present invention provides a water heater tank cleaning kit wherein the same utilizes a plurality of members to secure a duality of nozzles in vacuum communication with a vacuum cleaner to permit access and cleaning of sediment from a hot water tank. As such, the general purpose of the present invention, which will be described subsequently in greater detail, is to provide a new and improved water heater tank cleaning kit which has all the advantages of the prior art vacuum cleaning apparatus and none of the disadvantages.

To attain this, the present invention provides a kit including a coupler for sealing engagement to a vacuum intake nozzle such as utilized by "shop type" vacuum canisters. The kit further includes an adapter member threadedly securable to the coupler, wherein the adapter member sealingly and slidingly receives therewithin one of a plurality of vacuum wands of generally "L" shaped configuration, with a first wand defining an obtuse angle and the second wand defining an orthogonal relationship between its legs. The first and second wands are utilized to respectively clean a major and minor sector of a hot water tank, and particularly sediment collected on the bottom portion of the tank.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved water heater tank cleaning kit which has all the advantages of the prior art vacuum cleaning apparatus and none of the disadvantages.

It is another object of the present invention to provide a new and improved water heater tank cleaning kit which may be easily and efficiently manufactured and marketed.

It is a further object of the present invention to provide a new and improved water heater tank cleaning kit which is of a durable and reliable construction.

An even further object of the present invention is to provide a new and improved water heater tank cleaning kit which is susceptible of a low cost of manufacture with regard to both materials and labor, and which accordingly is then susceptible of low prices of sale to the consuming public, thereby making such water heater tank cleaning kits economically available to the buying public.

Still yet another object of the present invention is to provide a new and improved water heater tank cleaning kit which provides in the apparatuses and methods of the prior art some of the advantages thereof, while simultaneously overcoming some of the disadvantages normally associated therewith.

Still another object of the present invention is to provide a new and improved water heater tank cleaning kit wherein the same provides access and effective cleaning of an entire surface of a hot water tank lower portion collecting sediment therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 11 is an orthographic view taken along the lines 11—11 of FIG. 9 in the direction indicated by the arrows indicating a first sector of cleaning.

FIG. 12 is an orthographic cross-sectional view of the hot water tank of FIG. 9 illustrating the second sector of cleaning by the second vacuum line.

DESCRIPTION OF THE PREFERRED EMBODIMENT

Figure 1:
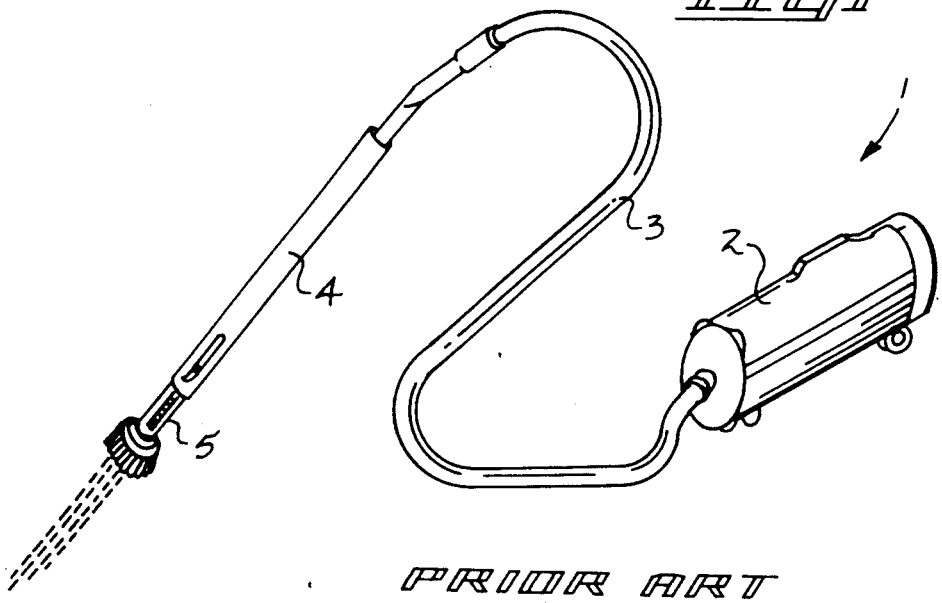
FIG. 1 is an isometric illustration of a prior art vacuum cleaning apparatus.

With reference now to the drawings, and in particular to FIGS. 1 to 13 thereof, a new and improved water heater tank cleaning kit embodying the principles and concepts of the present invention and generally designated by the reference numeral 10 will be described.

Figure 2:
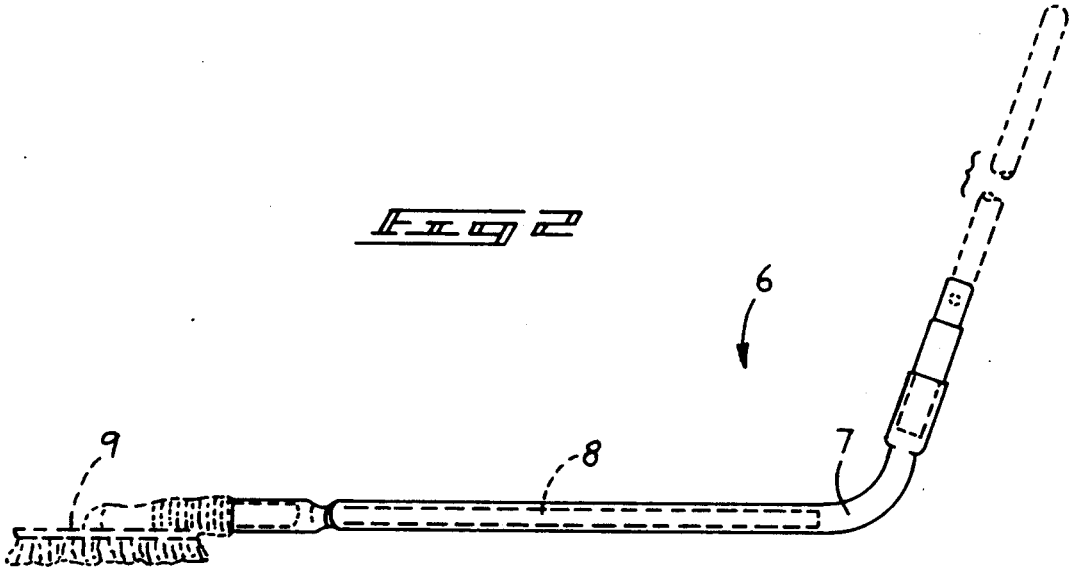
PRIOR ART Fig 2
FIG. 2 is a side orthographic view taken in elevation of a further prior art vacuum wand apparatus.

FIG. 1 is illustrative of a typical prior art vacuum cleaner assembly 1 comprising a vacuum canister tank 2 generating a vacuum and directing the vacuum through a flexible conduit 3 that in turn is mounted to a rigid conduit member 4. A telescoping vacuum wand 5 is telescopingly mounted within the rigid conduit 4 to selectively vary the effective length of the associated rigid member 4. Similarly, as illustrated in FIG. 2, a further prior art vacuum wand assembly 6 includes a rigid vacuum wand 7 including a telescoping wand 8 mounted interiorly thereof securing various brush type members 9 at a forward end thereof.

Figures 3, 4, 5:
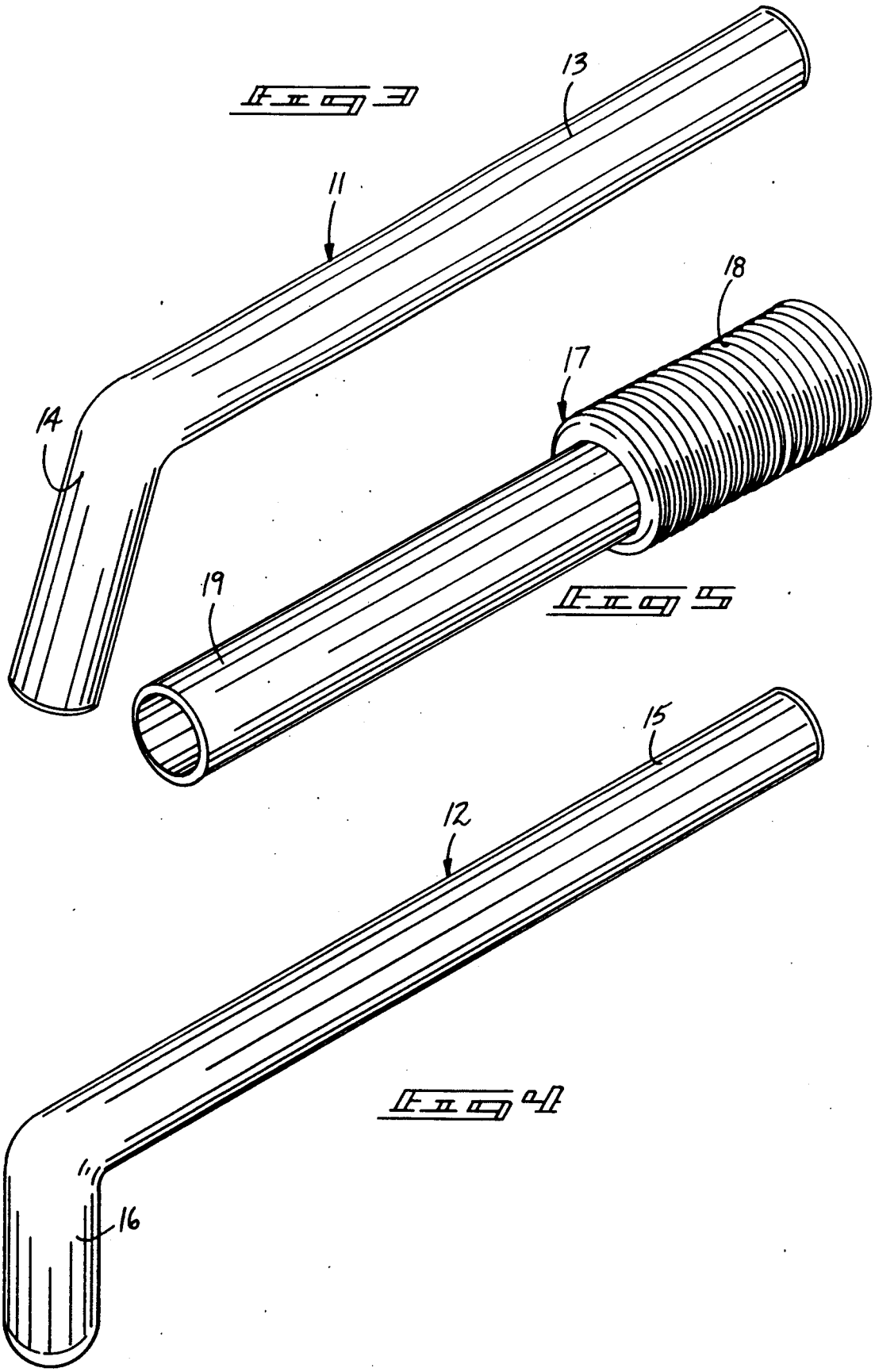
FIG. 3 is an isometric illustration of the first vacuum wand utilized by the instant invention.
FIG. 4 is an isometric illustration of the second vacuum wand utilized by the instant invention.
FIG. 5 is an isometric illustration of the adapter member utilized by the instant invention.
Figure 6:
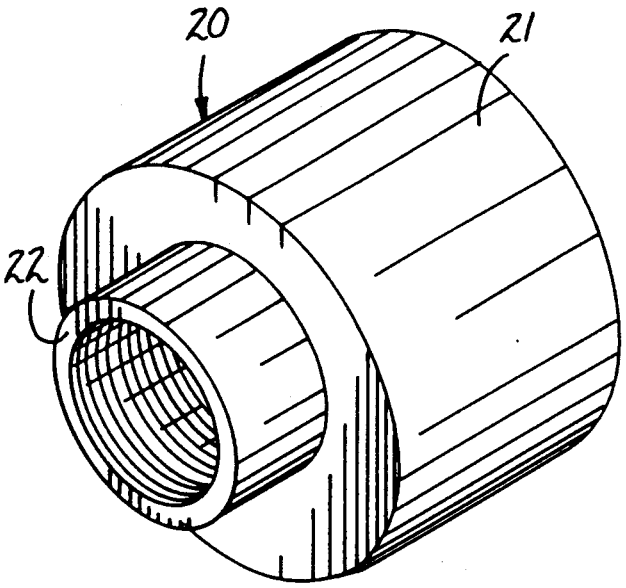
FIG. 6 is an isometric illustration of the coupler member utilized by the instant invention.

More specifically, the water heater tank cleaning kit apparatus 10 essentially comprises the use of a plurality of vacuum wands including a rigid first vacuum wand 11 of a generally "L" shaped configuration, and a second rigid vacuum wand 12 also of an "L" shaped configuration. Both wands 11 and 12 are of a tubular construction and of an identical predetermined external diameter that is consistent throughout the construction of each of the first and second wands 11 and 12. The first wand 11 includes a first wand leg 13 directed to a first wand second leg 14, wherein the first and second legs 13 and 14 define a generally obtuse angle between 110 and 120 degrees to provide access to a first cleaning area within a hot water tank. The second wand 12 includes a second wand first leg 15 and a second wand second leg 16, wherein the second wand first and second legs define a generally orthogonal angle therebetween to provide access to a second area within a hot water tank. The first and second areas of the hot water tank are illustrated in FIGS. 11 and 12 defining a bottom portion of a hot water tank with typical sediment therewithin. The first wand 11 avails itself of cleaning the first area 26, as illustrated in FIG. 12, with the second wand 12 arranged to clean the second area 25. The second area 25 defines a sector of approximately forty to sixty degrees, while the first area 26 defines a sector between three hundred to three hundred twenty degrees. The wands 11 and 12 must be utilized in concert to clean both areas of the water tank 23, as illustrated in FIG. 3, through an associated access door 24. It is understood therefore that the access door 24 limits positioning of the forward free ends of the wands therewithin requiring the use of both wands in the cleaning procedure.

Figure 7:
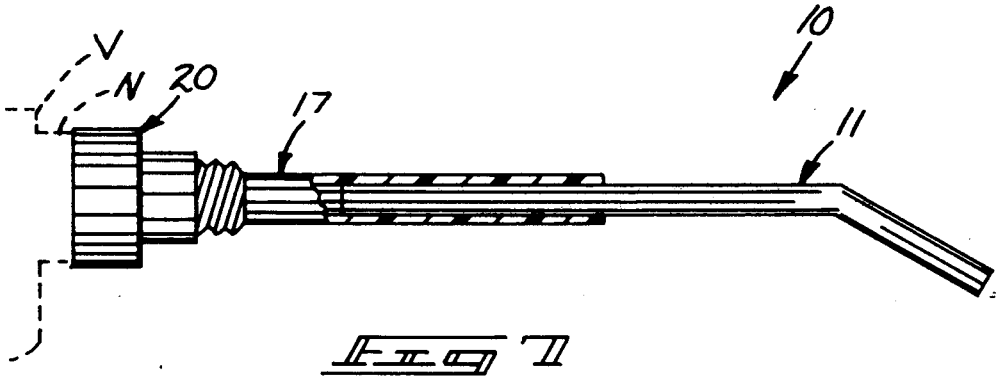
FIG. 7 is an orthographic view, partially in section, of the apparatus utilizing the first wand.
Figure 8:
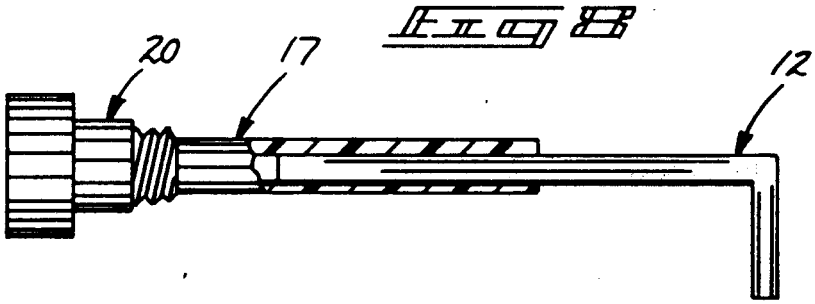
FIG. 8 is an orthographic side view taken partially in section of the apparatus utilizing the second vacuum wand of the instant invention.
Figure 9:
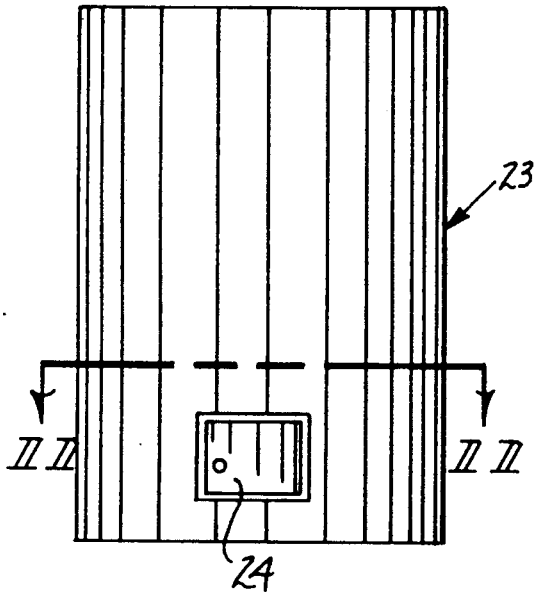
FIG. 9 is an orthographic view taken in elevation of a typical hot water tank.

FIG. 5 illustrates the adapter member 17 utilized by the instant invention, including an externally threaded first Tubular shaft portion coaxially aligned with a smooth second Tubular shaft portion. The second Tubular shaft portion defines an internal diameter equal to a predetermined external diameter defined by the first and second vacuum wands 11 and 12 to slidably and sealingly receive the respective first legs 13 and 15 of the respective first and second wands therewithin, as illustrated in FIGS. 7 and 8 for example. The adapter member 17 is threadedly received within a coupler 20. The coupler 20 includes a generally flexible cylindrical main body 21 with an axially aligned and internally threaded connector tube 22 to receive the threaded first Tubular shaft portion 18 therewithin. The flexible main body 21 is surroundingly and sealingly mounted to a nozzle "N" of an associated shop-type vacuum canister "V", as illustrated in FIG. 7.

Figure 10:
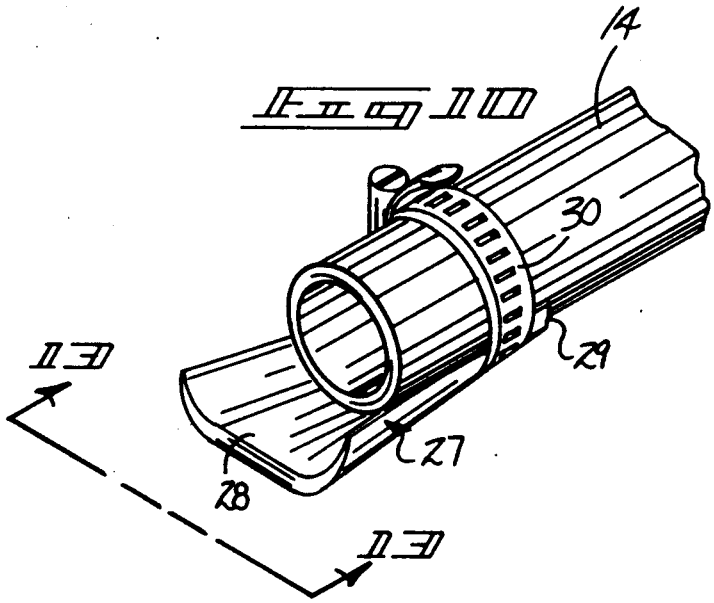
FIG. 10 is an isometric illustration of a scraper utilized by the first or second wand of the instant invention.
Figure 13:
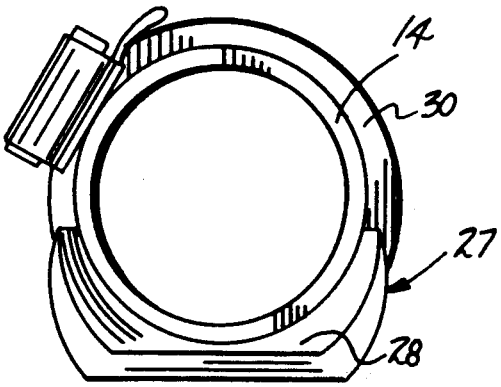
FIG. 13 is an orthographic view taken along the lines 13—13 of FIG. 10 in the direction indicated by the arrows.

FIG. 10 illustrates the use of a "V" shaped scraper member 27 provided as a generally "V" shaped cross-sectional body defined by a forward scraper edge 28 of a first width tapering to a narrowed rear edge 29 defining a spacing within the "U" shaped scraper 27 substantially equal to that of the predetermined external diameter of either the first or second wands 11 and 12 and their associated forward legs 14 or 16. A clamp 30 surroundingly engages and secures the scraper 27 to the associated wand, as illustrated in FIG. 10 for example.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A water tank cleaning kit apparatus for securement to a vacuum nozzle of a vacuum canister, the apparatus comprising, in combination, a first cylindrical coupler member securable to the nozzle, and an adapter member selectively and securably mounted to the coupler member, and a first "L" shaped wand defining an obtuse angle and a second "L" shaped wand defining a right angle, and the first and second "L" shaped wands telescopingly, sealingly, and selectively receivable within the adapter member, and wherein the coupler member includes a flexible, cylindrical main body, and an axially aligned and internally threaded connector tube mounted to the main body to define vacuum communication therebetween when the coupler member is secured to the nozzle, and wherein the adapter member includes an externally threaded first tubular shaft portion threadedly receivable within the connector tube of the coupler member, and an axially aligned second tubular shaft mounted to the first tubular shaft, wherein the first tubular shaft and the second tubular shaft are in vacuum communication with one another when the adapter member is secured to the coupler member, and the externally threaded first tubular shaft defining a first tubular shaft diameter greater than a second tubular shaft diameter defined by the second tubular shaft, and the second tubular shaft defining an internal diameter substantially equal to a predetermined external diameter defined by the first and second "L" shaped wands, and wherein the obtuse angle of the first "L" shaped wand defines an angle between 110 and 120 degrees, and further including a scraper blade of a generally "U" shaped cross-sectional configuration selectively mounted to a forward free end of either the first or second "L" shaped wand, and wherein the scraper blade defines a forward surface directed forwardly and defining a forward edge of a first width, and the scraper blade further including a rear edge defining a second width substantially equal to the predetermined external diameter, and a clamp member surroundingly clamping the scraper blade and a forward end portion of either the first or second wand.

* * * * *